US005699629A

United States Patent [19]

Munschy

[11] Patent Number: 5,699,629

[45] Date of Patent: Dec. 23, 1997

[54] ADJUSTABLE FOOTWEAR

[76] Inventor: Dorothy G. Munschy, 1512 Locust Ravine, Bakersfield, Calif. 93306

[21] Appl. No.: 698,975

[22] Filed: Aug. 8, 1996

[51] Int. Cl.[6] ..... A43B 11/00; A43B 3/26

[52] U.S. Cl. ..... 36/97; 36/50.1; 36/110; 36/105

[58] Field of Search ..... 36/50.1, 15, 132, 36/97, 105, 110

[56] References Cited

U.S. PATENT DOCUMENTS

| | | | |
|---|---|---|---|
| 520,417 | 5/1894 | Foss | 36/10 |
| 2,513,005 | 6/1950 | Crawford | 36/11.5 |
| 2,611,977 | 9/1952 | Yamada | 36/11.5 |
| 3,057,086 | 10/1962 | Rigsby | 36/112 |
| 4,486,965 | 12/1984 | Friton | 36/50.1 |
| 5,176,624 | 1/1993 | Kuehnreich | 36/50.1 |

FOREIGN PATENT DOCUMENTS

| | | | |
|---|---|---|---|
| 2 178 940 | 2/1987 | United Kingdom | 36/101 |

*Primary Examiner*—Paul T. Sewell
*Assistant Examiner*—Anthony Stashick
*Attorney, Agent, or Firm*—Robert M. Sperry

[57] ABSTRACT

An improved adjustable shoe comprising a semirigid sole which is releasably attachable to an upper formed with a bottom portion overlying said sole and having a pair of toe portions which can be overlapped to cover the toes of a foot and which carry releasable fastening means for attaching said toe portions to each other, together with a rear flap projecting beyond the rear end of said sole and foldable upward to define the rear end of the shoe and a pair of rear side flaps which can be overlapped and carry means for releasably attaching said rear flaps together to retain said rear flap.

7 Claims, 4 Drawing Sheets

ADJUSTABLE FOOTWEAR

FIELD OF INVENTION

This invention relates to footwear and is particularly directed to improved adjustable footwear and the like.

PRIOR ART

As is well know, people normally wear shoes to protect their feet against injury, dirt or contamination. However, human feet are often subject to swelling due to infection, disease, injury or various other causes which makes it difficult or impossible to fit one's foot into a shoe which was sized for an unswollen foot. On the other hand, these conditions often effect only one foot or effect each foot to a different degree. Hence, it is impractical to purchase only one oversized shoe or two different sized shoes for such occasions. Furthermore, it is often desirable to provide shoes for feet of a variety of sizes. This is especially true in hospitals and the like. Furthermore, as any parent knows, children's feet grow so rapidly that they often only wear a pair of shoes once or twice before they outgrow the shoes. Consequently, it would be desirable to provide a shoe which could be configured to accommodate feet of a variety of sizes. Various types of adjustable shoes have been proposed heretofore to solve these problems. Most of the prior art adjustable shoes have had limited adjustability. Others have been complex and difficult to manufacture and use, while others have been extremely expensive to produce and purchase. Other prior art adjustable shoes have been extremely uncomfortable to wear. Also, many prior art adjustable shoes have soft soles which are not suitable for outdoor use and which wear out quickly. In addition, many requests are received for outdoor shoes with adjustable features. Thus, for example, the soles of jogging shoes often wear out, while the uppers still have lots of wear left. Some of the better prior art adjustable shoes have been disclosed in Applicant's prior patents, such as the following:

| PAT. NO. | INVENTOR | ISSUED |
|---|---|---|
| 3,762,075 | Munschy | Oct. 2, 1973 |
| 4,136,468 | Munschy | Jan. 30, 1979 |
| 5,265,349 | Munschy | Nov. 30, 1993 |

Applicant's prior patents have each solved specific problems. However, none of the prior art adjustable shoes have been entirely satisfactory.

BRIEF SUMMARY AND OBJECTS OF INVENTION

These disadvantages of the prior art are overcome with the present invention and an adjustable shoe is provided which can quickly and easily be adjusted to fit substantially any desired foot and which can be refitted whenever necessary or desirable, yet which is comfortable to wear, both indoors and out and is inexpensive to produce and purchase.

The advantages of the present invention are preferably attained by providing an improved adjustable shoe comprising a semirigid sole which is releasably attachable to an upper formed with a bottom portion overlying said sole and having a pair of toe portions which can be overlapped to cover the toes of a foot and which carry releasable fastening means for attaching said toe portions to each other, together with a rear flap projecting beyond the rear end of said sole and foldable upward to define the rear end of the shoe and a pair of rear side flaps which can be overlapped and carry means for releasably attaching said rear flaps together to retain said rear flap.

Accordingly, it is an object of the present invention to provide an improved adjustable shoe.

Another object of the present invention is to provide an improved adjustable shoe which can quickly and easily be adjusted to fit substantially any desired foot size.

An additional object of the present invention is to provide an improved adjustable shoe which can be refitted whenever necessary or desirable.

A further object of the present invention is to provide an improved adjustable shoe which is comfortable to wear.

Another object of the present invention is to provide an improved adjustable shoe which is inexpensive to produce and purchase.

An additional object of the present invention is to provide an improved adjustable shoe having a releasably attachable sole.

A specific object of the present invention is to provide an improved adjustable shoe comprising a semirigid sole which is releasably attachable to an upper formed with a bottom portion overlying said sole and having a pair of toe portions which can be overlapped to cover the toes of a foot and which carry releasable fastening means for attaching said toe portions to each other, together with a rear flap projecting beyond the rear end of said sole and foldable upward to define the rear end of the shoe and a pair of rear side flaps which can be overlapped and carry means for releasably attaching said rear flaps together to retain said rear flap.

These and other objects and features of the present invention will be apparent from the following detailed description, taken with reference to the figures of the accompanying drawing.

DETAILED DESCRIPTION OF THE INVENTION

Figure 1:
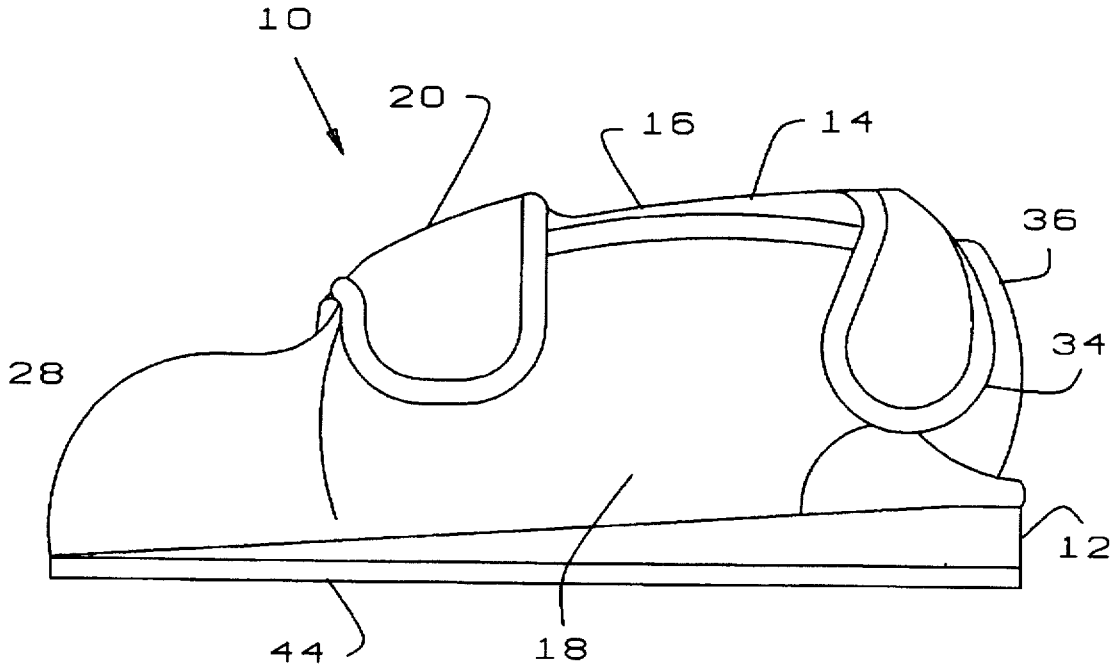
FIG. 1 is a side view of an adjustable shoe embodying the present invention.
Figure 2:
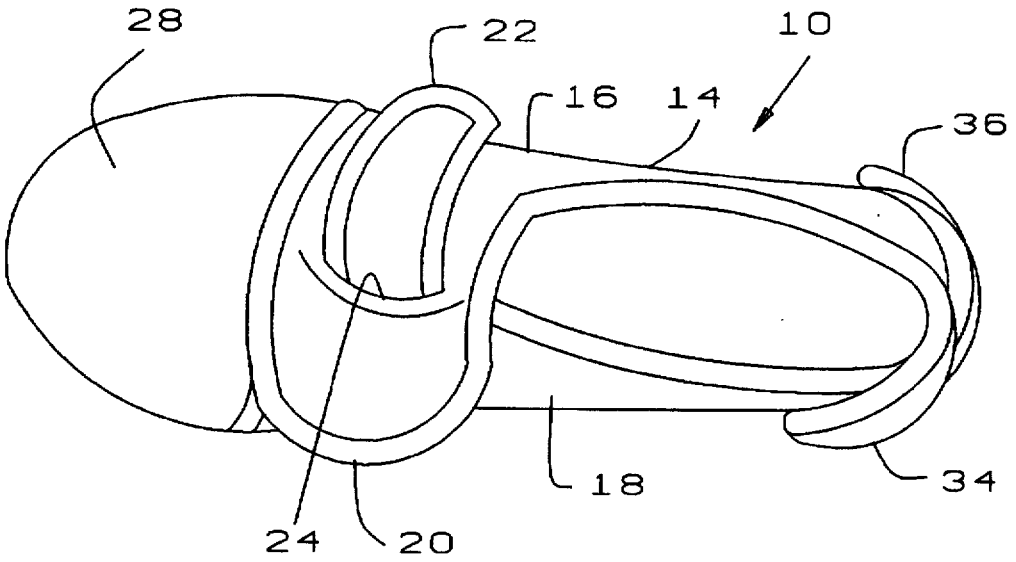
FIG. 2 is a top view of the adjustable shoe of FIG. 1.
Figure 3:
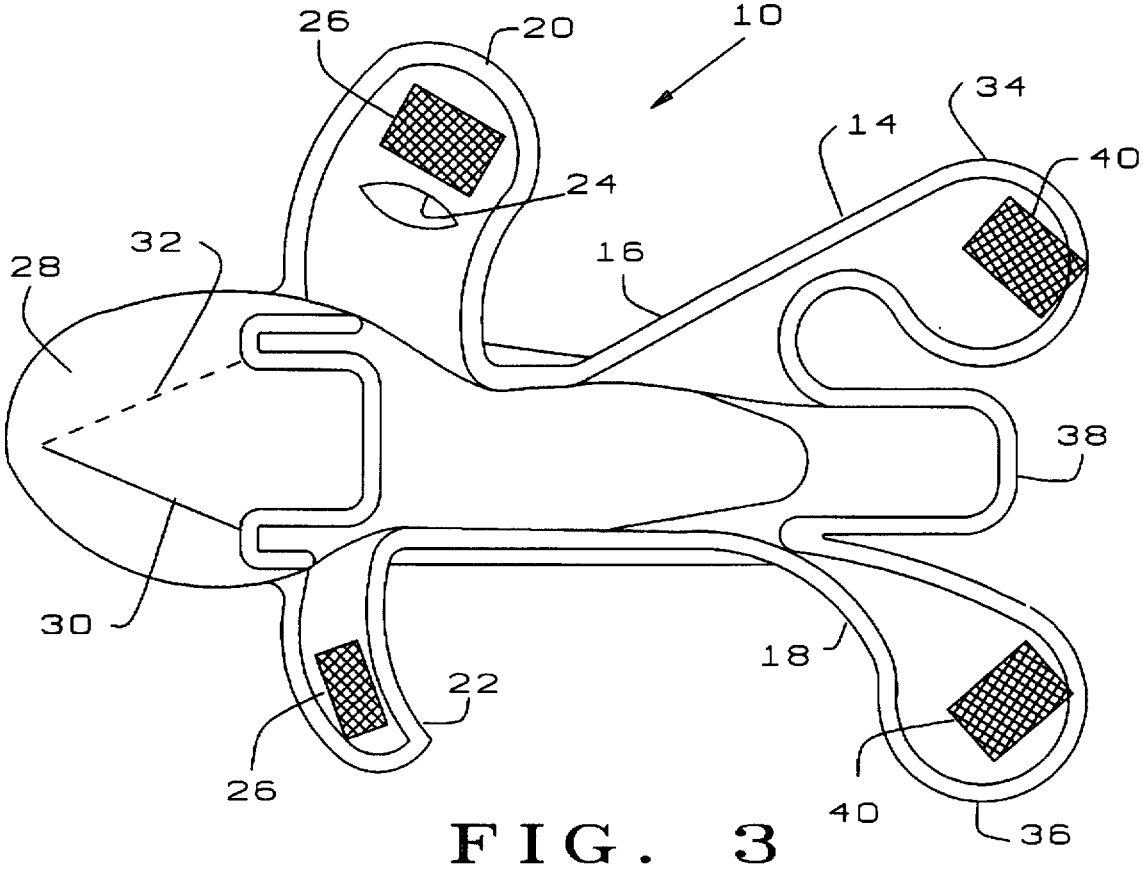
FIG. 3 is a view, similar to that of FIG. 2, showing the toe and rear portions of the shoe in the open positions.
Figure 4:
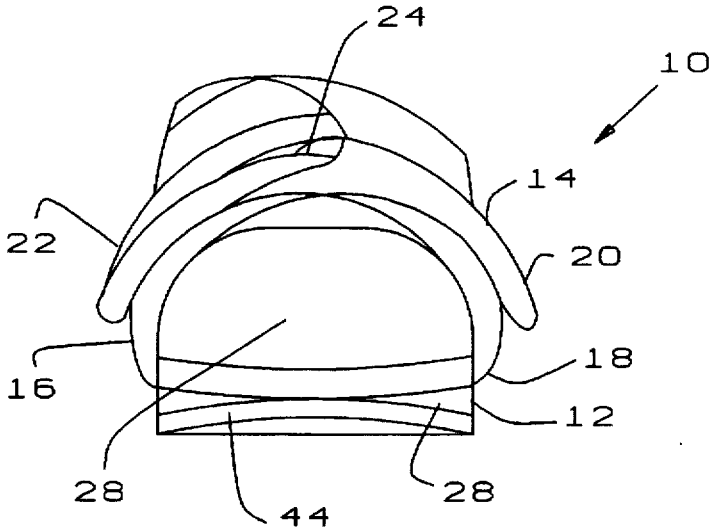
FIG. 4 is a front end view of the shoe of FIG. 1.
Figure 5:
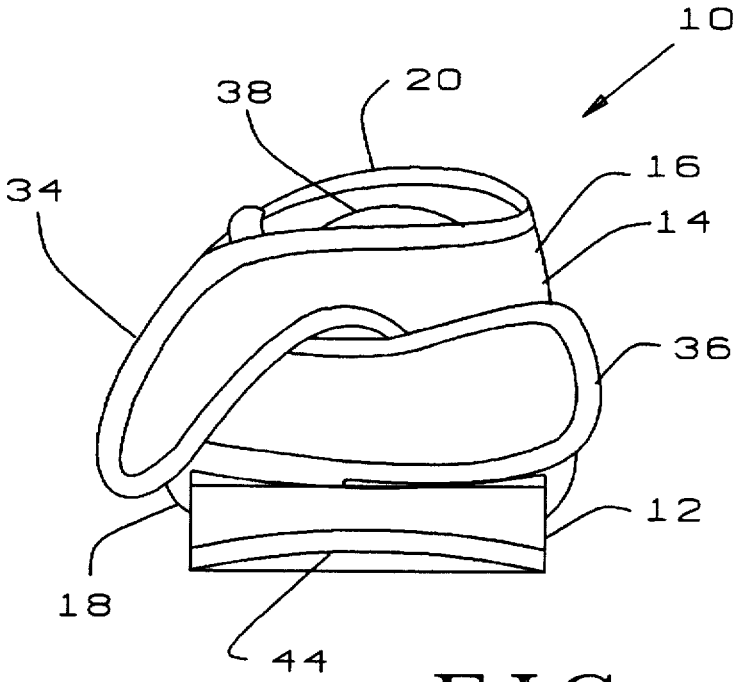
FIG. 5 is a rear end view of the shoe of FIG. 1.
Figure 6:
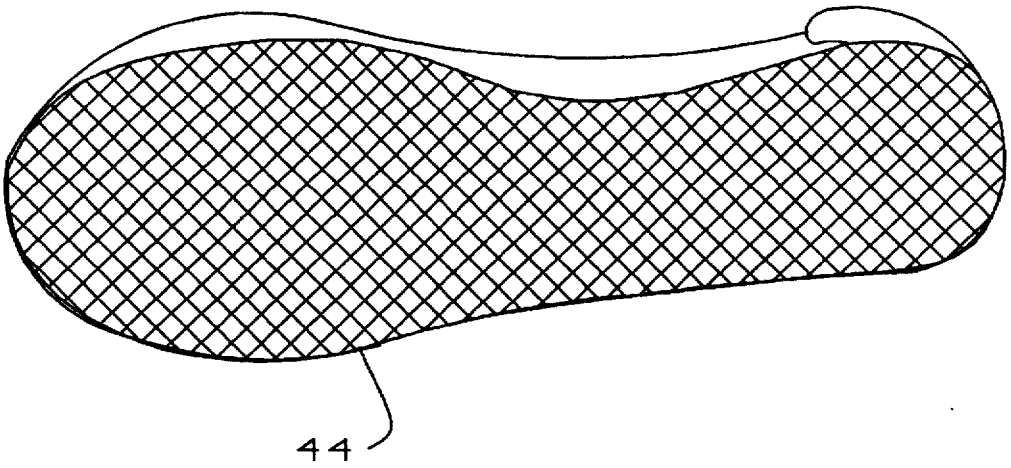
FIG. 6 is a bottom view of the upper of the adjustable shoe of FIG. 1.
Figure 7:
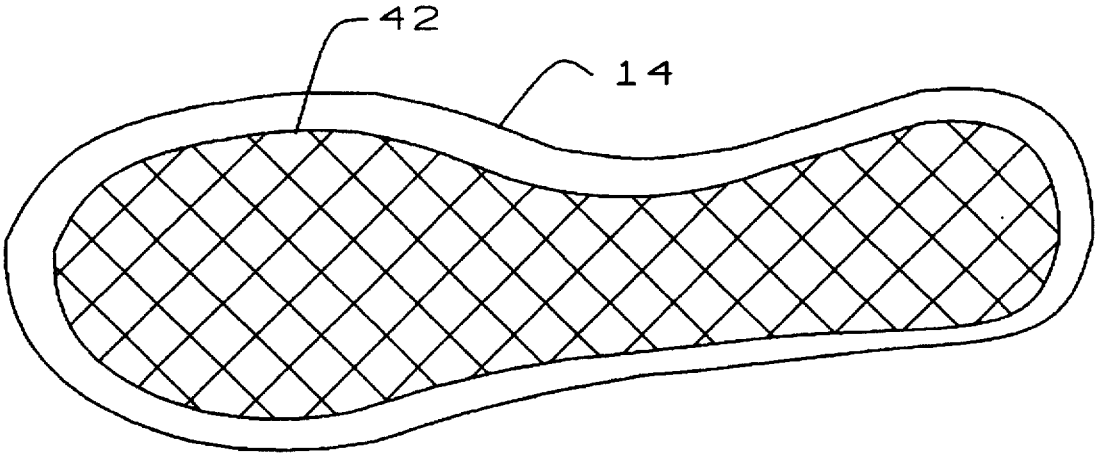
FIG. 7 is a top view of the sole of the adjustable shoe of FIG. 1.

In that form of the present invention chosen for purposes of illustration in the drawing, FIGS. 1–4 show an adjustable shoe, indicated generally at 10, having a sole 12 with an upper member 14 mounted thereon. As best seen in FIG. 3, the upper member 14 has a right side portion 16 and a left side portion 18, which are extendable upward form the sole 12 to lie along the respective sides of the wearer's foot. The side pieces 16 and 18 are formed with flaps 20 and 22 which are extendable to overlie the wearer's foot and flap 20 is formed with a slit 24, which allows flap 22 to be inserted therethrough, as best seen in FIGS. 2 and 4. Also, the flaps 20 and 22 carry releasable attaching means, such as patches 26 of hook-and-loop material, to allow the flaps 20 and 22 to be a adjusted to fit comfortably about the wearer's foot and releasably secured in a desired position. A toe portion 28 is mounted on the forward end of the sole 12 and has flaps 30 and 32 which overlap to cover the toe portion of the wearer's foot, as best seen in FIG. 3. The flaps 20 and 22 of the side portions 16 and 18 overlie the flaps 30 and 32 of the toe portion 28 to retain the flaps 20 and 22 in position, as seen in FIGS. 1, 2 and 4. As best seen in FIGS. 3 and 5, the side portions 16 and 18 are also provided with rear side flaps 34 and 36, while a central rear flap 38 projects rearwardly from the upper 14 between the rear side portions 16 and 18. The rear side flaps 34 and 36 are extendable about the rear flap 38 to form the back of the shoe 10 and each carry releasable fastening means, such as patches 40 of hook-and-loop material to releasably attach the rear side flaps 34 and 36 together. Finally, as best seen in FIG. 7, the bottom surface of the sole 12 carries a sheet 42 of releasable fastening material, such as hook-and-loop material, to allow an undersole 44 to be releasably attached to the sole 12.

In use, the wearer slides his toes into the toe portion 28 and adjusts flaps 30 and 32 to comfortably cover the forward part of the wearer's foot. Next, the wearer folds side flaps 20 and 22 above his foot, inserts flap 22 through slit 24 of flap 20, pulls the flaps 20 and 22 to comfortably fit over his foot and engages the releasable attaching means 26 to secure the flaps 20 and 22 in the desired position. Since flaps 20 and 22 overlie flaps 30 and 32 of the toe portion 28, the flaps 20 and 22 also serve to retain the toe flaps 30 and 32 in their desired positions. Thereafter, the wearer lifts rear flap 38 to lie behind the wearer's heel, overlaps the rear side flaps 34 and 36 behind rear flap 38, and engages releasable fastening means 40 to releasably secure the rear side flaps 34 and 36 together to complete the shoe 10. Finally, the wearer places the undersole 44 beneath the sole 12 and steps on it to cause the releasable fastening means 42 to releasably attach the undersole 44 to the shoe 10. subsequently, if the undersole 44 begins to wear out, the wearer can simply peel off the old undersole 44 and replace it with a new one to allow continued usage of the sole 12 and upper 14 of the shoe 10. If the shape or size of the wearer's foot changes, the wearer can loosen side flaps 20 and 22 to readjust the fit of the shoe or can release the rear side flaps 34 and 36 and reposition the rear flap 38 to readjust the length of the shoe 10. Thus, it will be seen that the shoe 10 can quickly and easily be adjusted to accommodate substantially any size of shape of foot and can quickly and easily be readjusted to conform to changes in the shape or length of the foot. Moreover, should the undersole 44 become worn, it can be replaced, with little or no effort, to allow continued use of the shoe 10.

Figure 8:
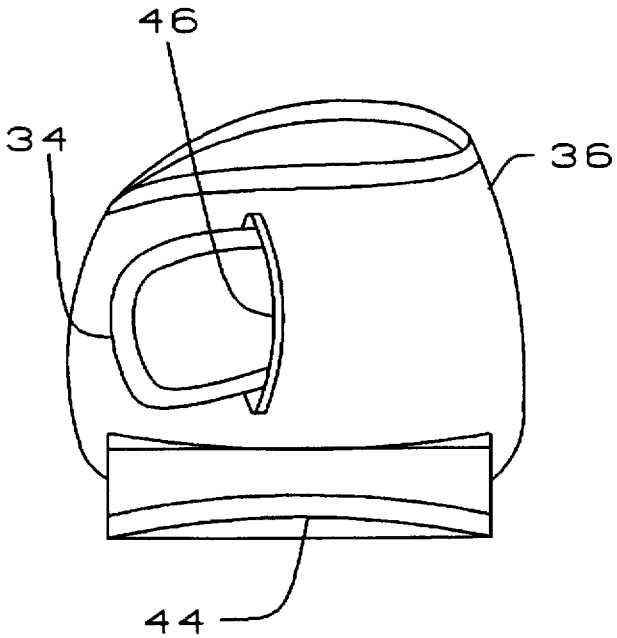
FIG. 8 is a rear view showing an alternative means of securing the rear flaps of the adjustable shoe of FIG. 1.

FIG. 8 shows an alternative means for securing the rear flaps 34 and 36. In this form, one of the rear side flaps, for example flap 36 has a slit 46 formed therein which allows the other rear flap 34 to be inserted therethrough and attached the side portions 16 and 18 a manner similar to that described above with respect to flaps 20 and 22. This serves to adjustably enclose the rear flap 38 to comfortably accommodate substantially any size foot.

Obviously, numerous variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. An adjustable shoe comprising:

an upper formed with a sole portion, a toe portion located adjacent the forward end of said sole portion formed with a pair of overlapping flaps said flaps overlapping each other extendable over the toes of a foot for covering the toes of said foot, side portions having flaps extendable to overlie said foot and said toe portion carrying releasable fastening means for attaching said flaps to each other, together with a rear flap projecting rearwardly from said sole and foldable upward to define the rear end of the shoe and a pair of rear side flaps projecting from said side portions which can be overlapped behind said rear flap and which carry means for releasably attaching said rear side flaps together to retain said rear flap.

2. The shoe of claim 1 wherein:

the flaps of said side portions overlie said flaps of said toe portion when extended over said foot to retain said flaps of said toe portion in a desired position.

3. The shoe of claim 1 wherein:

said releasable fastening means are patches of hook-and-loop material.

4. The shoe of claim 1 wherein:

said means for releasably attaching said rear side flaps are patches of hook-and-loop material carried by said rear side flaps.

5. The shoe of claim 1 wherein:

one of the flaps of said side portions is provided with a slit and the other of said flaps is insertable through said slit to facilitate fitting said flaps to comfortably overlie said foot.

6. The shoe of claim 1 further comprising:

an undersole releasably attachable to said shoe.

7. The shoe of claim 1 wherein:

one of said rear side flaps is formed with a slit to permit insertion therethrough of the other of said rear side flaps.

* * * * *